US011472669B2

(12) United States Patent
Lee

(10) Patent No.: US 11,472,669 B2
(45) Date of Patent: Oct. 18, 2022

(54) METHOD OF HIGHLY EFFICIENTLY OPERATING ELEVATOR BY ANALYZING OPERATION OF ELEVATOR

(71) Applicants: ITS CO., LTD., Ulsan (KR); Youngkyu Lee, Ulsan (KR)

(72) Inventor: Youngkyu Lee, Ulsan (KR)

(73) Assignees: ITS CO., LTD., Ulsan (KR); Youngkyu Lee, Ulsan (KR)

( * ) Notice: Subject to any disclaimer, the term of this patent is extended or adjusted under 35 U.S.C. 154(b) by 852 days.

(21) Appl. No.: 16/389,665

(22) Filed: Apr. 19, 2019

(65) Prior Publication Data

US 2019/0300335 A1 Oct. 3, 2019

Related U.S. Application Data

(63) Continuation of application No. PCT/KR2018/013163, filed on Nov. 1, 2018.

(30) Foreign Application Priority Data

Nov. 13, 2017 (KR) ..... 10-2017-0150473

(51) Int. Cl.
*B66B 5/00* (2006.01)
*B66B 13/14* (2006.01)
(Continued)

(52) U.S. Cl.
CPC ..... *B66B 5/0037* (2013.01); *B66B 1/302* (2013.01); *B66B 1/3407* (2013.01);
(Continued)

(58) Field of Classification Search
CPC ..... B66B 5/0037; B66B 1/302; B66B 1/3407; B66B 5/0012; B66B 5/0018; B66B 13/146; B66B 2201/4692; B66B 13/14
See application file for complete search history.

(56) References Cited

U.S. PATENT DOCUMENTS

2018/0334363 A1* 11/2018 Saarela ..... B66B 13/22
2020/0109025 A1* 4/2020 Simcik ..... B66B 1/3423

FOREIGN PATENT DOCUMENTS

CN 103863921 A 6/2014
EP 0 565 864 A1 10/1993
(Continued)

*Primary Examiner* — Jeffrey Donels
(74) *Attorney, Agent, or Firm* — Studebaker & Brackett PC

(57) ABSTRACT

The present invention relates to a method of highly efficiently operating an elevator by analyzing an operation of the elevator, including: a base information collecting step of measuring and collecting information on a change over time in magnitudes of current values of a driving unit when the driving unit for moving the elevator upward or downward moves the elevator upward in a normal state, measuring and collecting information on a change over time in magnitudes of current values of the driving unit when moving the elevator downward, classifying the measured information into driving information of the driving unit when moving the elevator upward and driving information of the driving unit when moving the elevator downward, and storing the driving information of the driving unit when moving the elevator upward and the driving information of the driving unit when moving the elevator downward as base information of the driving unit.

4 Claims, 7 Drawing Sheets

(51) Int. Cl.
*B66B 1/30* (2006.01)
*B66B 1/34* (2006.01)

(52) U.S. Cl.
CPC ..... *B66B 5/0012* (2013.01); *B66B 5/0018* (2013.01); *B66B 13/146* (2013.01)

(56) References Cited

FOREIGN PATENT DOCUMENTS

| | | | |
|---|---|---|---|
| JP | S55-82273 | U | 6/1980 |
| JP | S59-22864 | A | 2/1984 |
| JP | 2005-053628 | A | 3/2005 |
| JP | 2007-001733 | A | 1/2007 |
| JP | 2007-055700 | A | 3/2007 |
| JP | 2007-254069 | A | 10/2007 |
| JP | 2009-149425 | A | 7/2009 |
| JP | 2009-215040 | A | 9/2009 |
| KR | 10-1997-0026881 | A | 6/1997 |
| KR | 10-2000-0020216 | A | 4/2000 |
| WO | 2007/039925 | A1 | 4/2007 |

* cited by examiner

FIG. 6

| | Number of Operations for Current Day | Total Number of Operations for Current Month |
|---|---|---|
| Seventh Floor | 45 | 1,350 |
| Sixth Floor | 24 | 720 |
| Fifth Floor | 21 | 630 |
| Fourth Floor | 15 | 450 |
| Third Floor | 12 | 360 |
| Second Floor | 6 | 180 |
| First Floor | 60 | 2,700 |

FIRST FLOOR

SECOND FLOOR

FIG. 8

| | Total Number of Operations for Current Month | Electricity Rate (Total: 1,742,160 KRW) |
|---|---|---|
| Seventh Floor | 1,350 | 368,062 KRW |
| Sixth Floor | 720 | 196,299 KRW |
| Fifth Floor | 630 | 171,762 KRW |
| Fourth Floor | 450 | 122,688 KRW |
| Third Floor | 360 | 98,149 KRW |
| Second Floor | 180 | 49,076 KRW |
| First Floor | 2,700 | 736,124 KRW |

METHOD OF HIGHLY EFFICIENTLY OPERATING ELEVATOR BY ANALYZING OPERATION OF ELEVATOR

CROSS-REFERENCE TO RELATED APPLICATIONS

The present application is a continuation of International Patent Application No. PCT/KR2018/013163, filed Nov. 1, 2018, which is based upon and claims the benefit of priority to Korean Patent Application No. 10-2017-0150473, filed on Nov. 13, 2017. The disclosures of the above-listed applications are hereby incorporated by reference herein in their entirety.

TECHNICAL FIELD

The present invention relates to a method of highly efficiently operating an elevator by analyzing an operation of the elevator, and more particularly, to a method of highly efficiently operating an elevator by analyzing an operation of the elevator which distinguishes between an upward movement condition and a downward movement condition of the elevator, collects the driving information of the driving unit (the information on the change in current values over time), extracts the operating information of the elevator by analyzing the driving information of the driving unit in real time based on the collected information, digitizes (statistically calculates) the number of operations of the elevator for the respective floors, the time when the elevator operates, and the number of passengers based on the extracted operating information, and controls the door closing time of the elevator for the respective floors based on the digitized information, thereby implementing the economic operation of the elevator.

BACKGROUND ART

In general, an elevator is installed to quickly move between floors in a multi-story building, and the installation of the elevator is continuously increased because of an increase in high-rise buildings and convenience of use. In Korea, about 25,000 elevators are newly installed every year, and about 2 million elevators are expected to be installed by 2020.

Because the elevator is usually operated manually by a passenger, situations, such as the number of operations for respective floors, the time when the elevator operates, and the number of passengers, are not considered at all, and as a result, the elevator cannot be efficiently operated.

In addition, in the related art, because the electricity rates for the operation of the elevator are usually calculated for the respective floors without considering the situations related to the substantial use of electricity for the respective floors such as the number of operations for the respective floors, there is a problem in that the rates for the elevator cannot be reasonably calculated.

Technical Problem

The present invention has been made in an effort to solve the various problems, and an object of the present invention is to provide a method of highly efficiently operating an elevator by analyzing an operation of the elevator which distinguishes between an upward movement condition and a downward movement condition of the elevator, collects the driving information of the driving unit (the information on the change in current values over time), extracts the operating information of the elevator by analyzing the driving information of the driving unit in real time based on the collected information, digitizes (statistically calculates) the number of operations of the elevator for the respective floors, the time when the elevator operates, and the number of passengers based on the extracted operating information, and controls the door closing time of the elevator for the respective floors based on the digitized information, thereby implementing the economic operation of the elevator.

Another object of the present invention is to provide a method of highly efficiently operating an elevator by analyzing an operation of the elevator which may clearly distribute electricity rates for an operation of the elevator in proportion to the digitized number of operations of the elevator for respective floors, thereby calculating very reasonable rates.

Technical Solution

To achieve the above-mentioned objects, a method of highly efficiently operating an elevator by analyzing an operation of the elevator according to the present invention includes: a base information collecting step S10 of measuring and collecting information on a change over time in magnitudes of current values of a driving unit when the driving unit for moving the elevator upward or downward moves the elevator upward in a normal state, measuring and collecting information on a change over time in magnitudes of current values of the driving unit when moving the elevator downward, classifying the measured information into driving information of the driving unit when moving the elevator upward and driving information of the driving unit when moving the elevator downward, and storing the driving information of the driving unit when moving the elevator upward and the driving information of the driving unit when moving the elevator downward as base information of the driving unit; an operating information storing step S20 of measuring in real time the driving information of the driving unit when the driving unit operates, analyzing the measured information based on the base information of the driving unit which is collected in the base information collecting step S10, and extracting and storing the operating information of the elevator; and an operation control step S30 of analyzing and digitizing the operating information of the elevator which is stored for a long period of time in the operating information storing step S20, and controlling door closing time of the elevator for respective floors based on the digitized information.

In addition, the driving information of the driving unit, which is collected in the base information collecting step S10, is collected by being classified into an activated section in which the driving unit begins to operate to move the elevator upward or downward, a constant-speed section in which the current values of the driving unit are stabilized and maintained within a predetermined range during the process of moving the elevator upward or downward, and a stopped section in which the driving unit stops operating to stop the elevator, the operating information storing step S20 collects the driving information of the driving unit, which is collected in real time, while classifying the driving information into the activated section, the constant-speed section, and the stopped section like in the base information collecting step S10, tracks the operating section of the elevator by comparing the base information collected in the base information collecting step S10 with the collected time for which the constant-speed section is maintained and the information on current values, and finally extracts and stores the number of operations of the elevator for the respective floors, and the operation control step S30 digitizes the number of operations of the elevator for the respective floors based on the information collected for a long period of time in the operating information storing step S20, and allows a maximum number of passengers to get in the elevator by extending, based on the digitized information, the door closing time of the elevator in the floor where the elevator operates frequently in order to allow the number of operations of the elevator to be naturally reduced.

In addition, the operating information storing step S20 extracts and stores the information on the time when the elevator driving unit operates and the information on the number of passengers, and the operation control step S30 controls the door closing time of the elevator based on the time when the driving unit operates and the information on passengers which are digitized together with the number of operations of the elevator for the respective floors.

In addition, the method further includes a calculation step S40 of separating and calculating electricity rates for the elevator for the respective floors in proportion to the number of operations for the respective floors based on the number of operations of the elevator for the respective floors which is digitized in the operation control step S30.

Advantageous Effects

The above-mentioned method of highly efficiently operating the elevator by analyzing the operation of the elevator according to the present invention distinguishes between an upward movement condition and a downward movement condition of the elevator, collects the driving information of the driving unit (the information on the change in current values over time), extracts the operating information of the elevator by analyzing the driving information of the driving unit in real time based on the collected information, digitizes (statistically calculates) the number of operations of the elevator for the respective floors, the time when the elevator operates, and the number of passengers based on the extracted operating information, and controls the door closing time of the elevator for the respective floors based on the digitized information, thereby implementing the economic operation of the elevator.

In addition, it is possible to clearly distribute the electricity rates for the operation of the elevator in proportion to the digitized number of operations of the elevator for the respective floors, and as a result, it is possible to calculate the very reasonable rates.

BRIEF DESCRIPTION OF DRAWINGS

FIG. 6 is a table of number of operations of elevator for respective floors.

FIG. 8 is a table of electricity rates for respective floors depending on number of operations of elevator.

DESCRIPTION OF MAIN REFERENCE NUMERALS OF DRAWINGS

S10: Base information collecting step
S20: Operating information storing step
S30: Operation control step
S40: Calculation step
100: Method of highly efficiently operating elevator by analyzing operation of elevator

DETAILED DESCRIPTION

A method of highly efficiently operating an elevator by analyzing an operation of the elevator according to an exemplary embodiment of the present invention will be described in detail with reference to the accompanying drawings. Descriptions of publicly known related functions or configurations will be omitted when it is determined that the specific descriptions may unnecessarily obscure the subject matter of the present disclosure.

Figure 1:
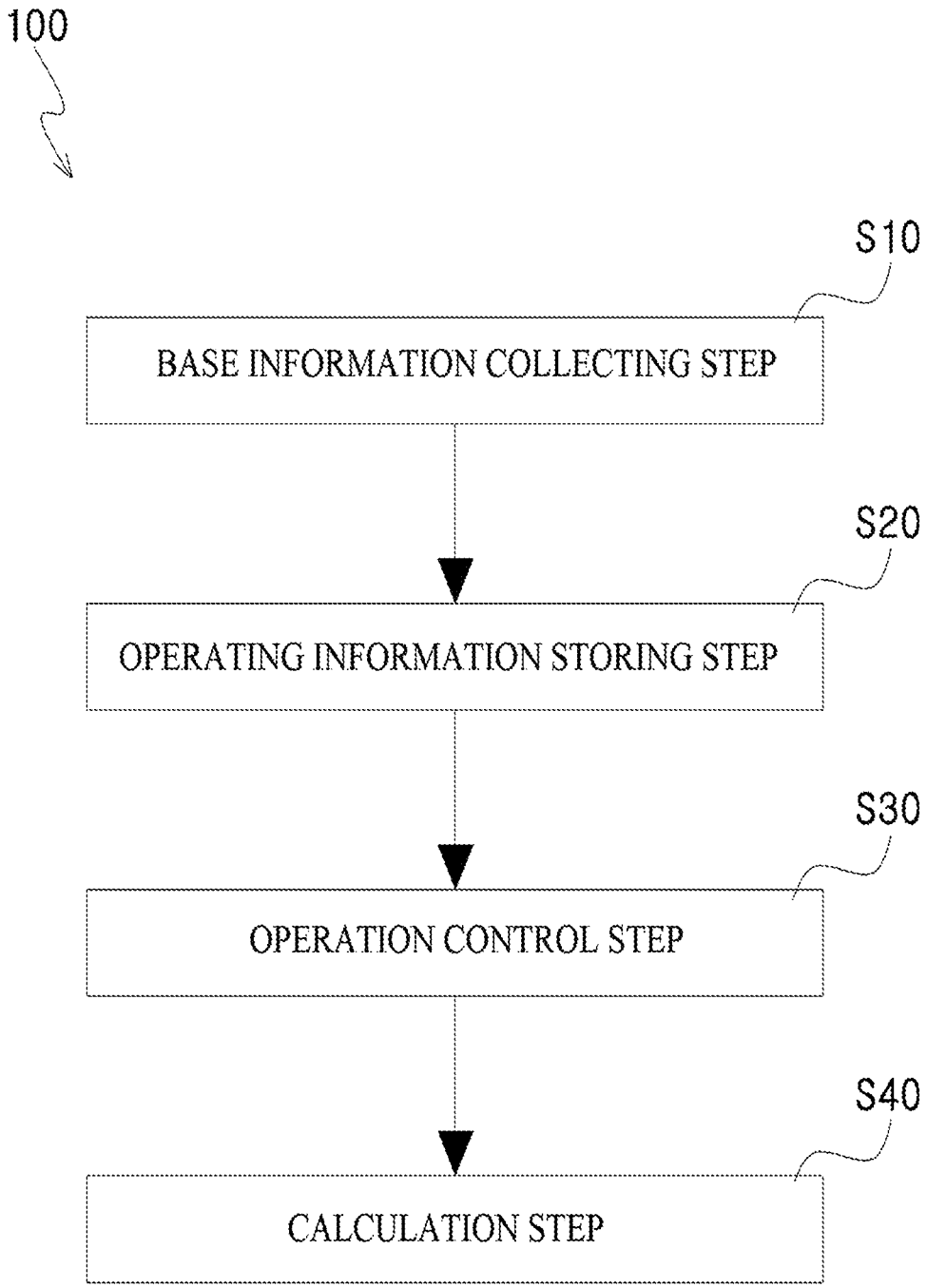
FIG. 1 is a block diagram of a method of highly efficiently operating an elevator by analyzing an operation of an elevator according to an exemplary embodiment of the present invention.

FIG. 1 is a block diagram of a method of highly efficiently operating an elevator by analyzing an operation of an elevator according to an exemplary embodiment of the present invention.

As illustrated in FIG. 1, a method 100 of highly efficiently operating an elevator by analyzing an operation of the elevator according to an exemplary embodiment of the present invention includes a base information collecting step S10, an operating information storing step S20, and an operation control step S30.

The base information collecting step S10 is a step of measuring and collecting information on a change over time in magnitudes of current values of a driving unit when the driving unit for moving an elevator upward or downward moves the elevator upward in a normal state, measuring and collecting information on a change over time in magnitudes of current values of the driving unit when moving the elevator downward, classifying the measured information into driving information of the driving unit when moving the elevator upward and driving information of the driving unit when moving the elevator downward, and storing the driving information of the driving unit when moving the elevator upward and the driving information of the driving unit when moving the elevator downward as base information of the driving unit.

Here, the elevator is a structure that moves continuously upward or downward between lower floors and upper floors. Because the elevator is moved upward or downward by power of the driving unit, the driving information of the driving unit (the information on the change over time in magnitudes of current values), which is collected in the base information collecting step S10, may be collected and stored as the base information by being made as a database including the driving information of the driving unit when moving the elevator upward and the driving information of the driving unit when moving the elevator downward.

Figure 2:
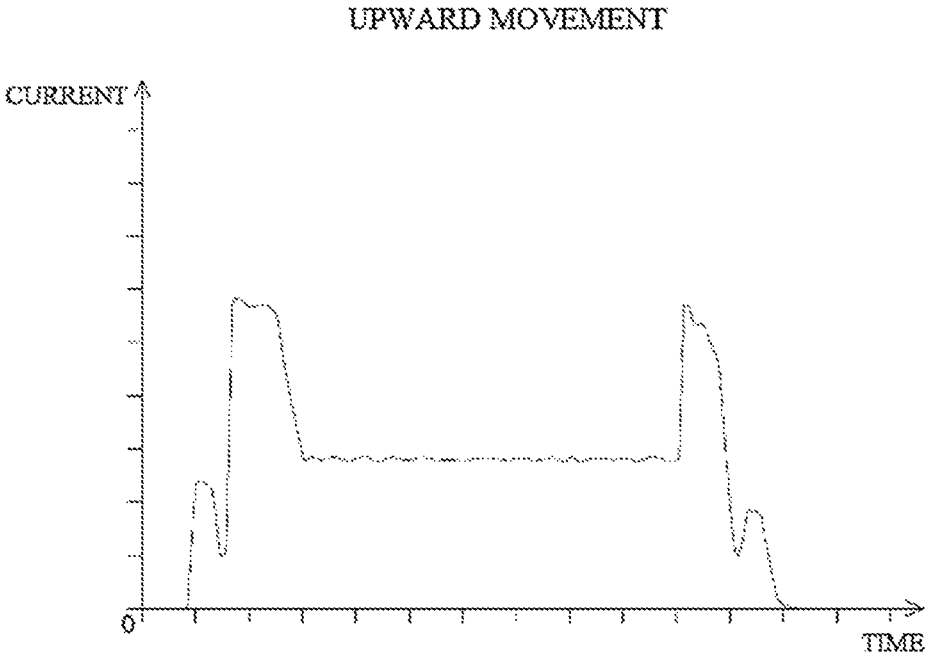
FIG. 2 is a graph illustrating current values over time of driving unit when moving elevator upward.

FIG. 2 is a graph illustrating current values over time of driving unit when moving elevator upward.

Figure 3:
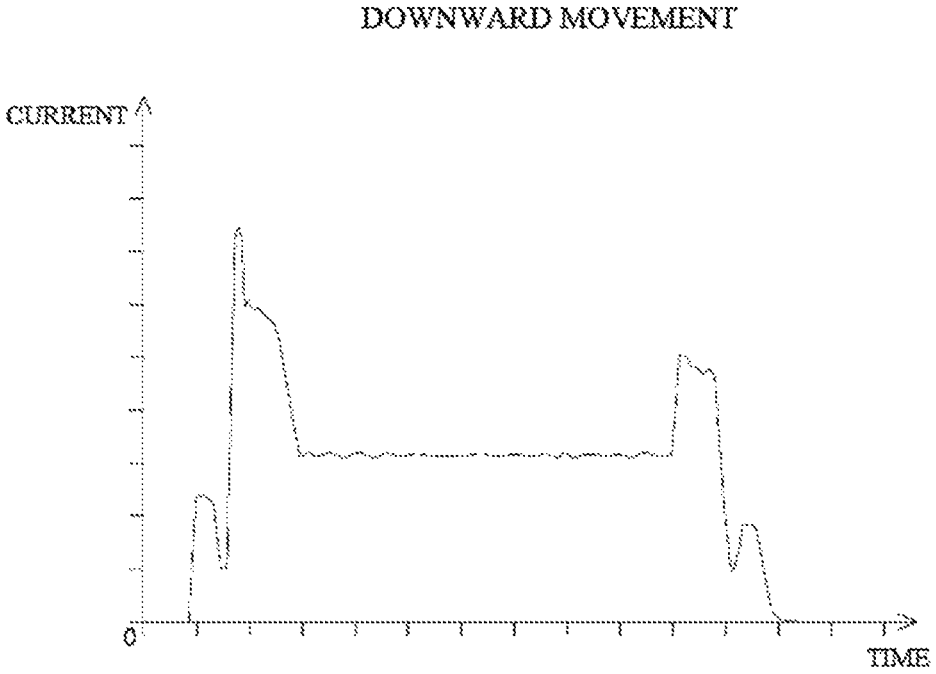
FIG. 3 is a graph illustrating current values over time of driving unit when moving elevator downward.

FIG. 3 is a graph illustrating current values over time of driving unit when moving elevator downward.

As illustrated in FIGS. 2 and 3, the reason is that there is a difference between a current value required for the driving unit when moving the elevator upward and a current value required for the driving unit when moving the elevator downward. The base information stored in the base information storing step S10 is used as the base information for analyzing the driving information of the driving unit which is collected in real time in the operating information storing step S20 to be described below, and thus the driving information of the driving unit, which is collected in the base information storing step as described above, is stored and managed by being classified into the driving information when moving the elevator upward and the driving information when moving the elevator downward.

Figure 4:
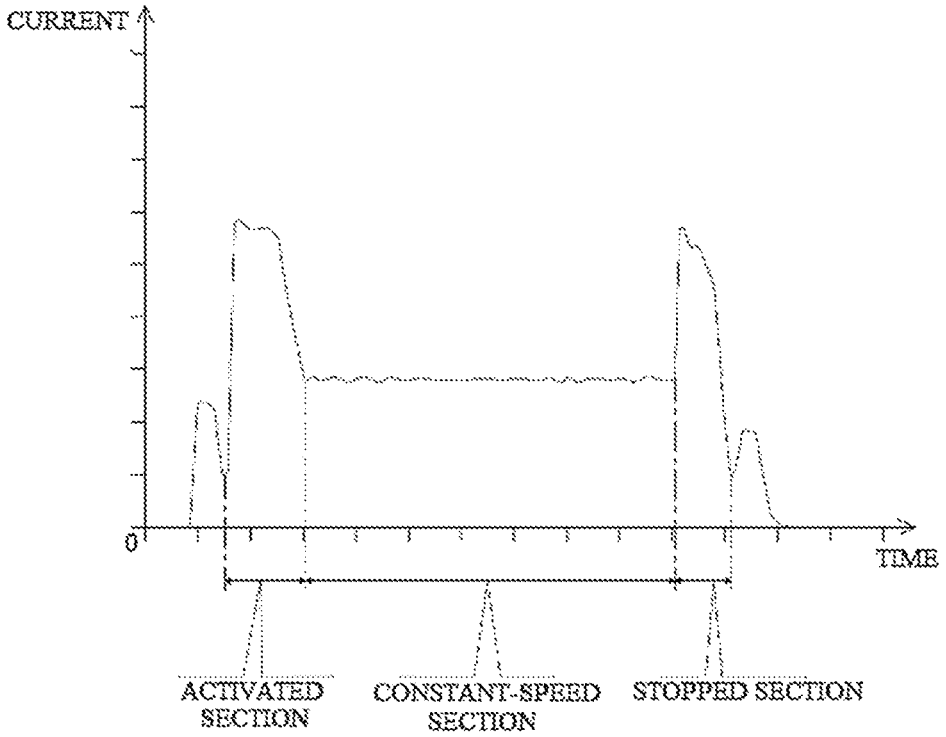
FIG. 4 is a graph illustrating driving information of elevator driving unit for respective sections.

FIG. 4 is a graph illustrating driving information of elevator driving unit for respective sections.

The driving information of the driving unit, which is collected in the base information collecting step S10, is collected by being classified into an activated section in which the driving unit begins to operate to move the elevator upward or downward, a constant-speed section in which the current values of the driving unit are stabilized and maintained within a predetermined range during the process of moving the elevator upward or downward, and a stopped section in which the driving unit stops operating to stop the elevator, as illustrated in FIG. 4.

The reason why the sections are set as described above is that since the activated section and the stopped section are sections in which a peak current (overcurrent) is instantaneously produced, a start point and an end point of the constant-speed section may be clearly set (defined) based on the activated section and the stopped section, and information on the time for which the constant-speed section is maintained with respect to an operating section (operating distance) in which the elevator operates may be clearly extracted.

Figure 5A:
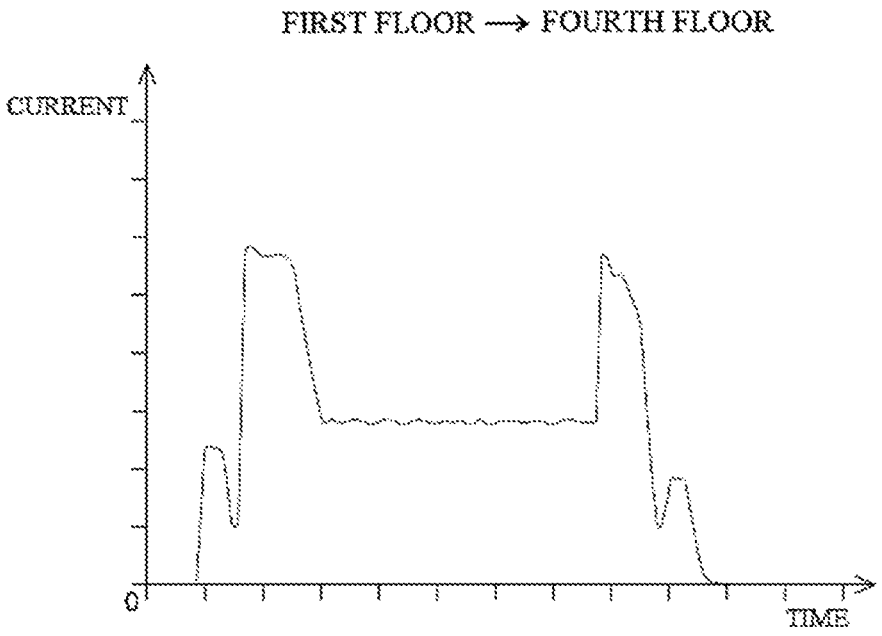
FIG. 5A is a graph illustrating time for which constant-speed section is maintained depending on elevator operating section.

FIG. 5A is a graph illustrating time for which constant-speed section is maintained depending on elevator operating section.

Figure 5B:
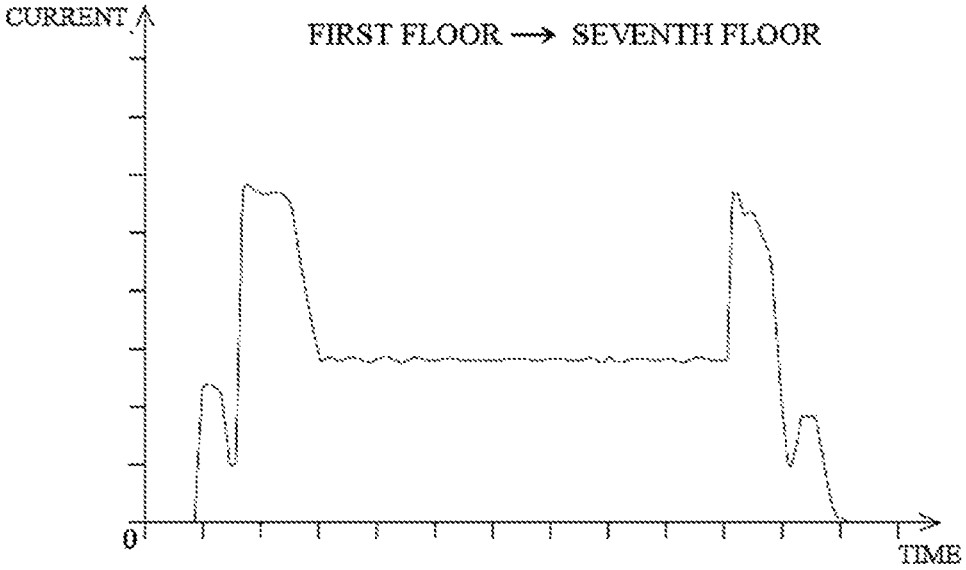
FIG. 5B is a graph illustrating time for which constant-speed section is maintained depending on elevator operating section.

FIG. 5B is a graph illustrating time for which constant-speed section is maintained depending on elevator operating section.

As illustrated in FIGS. 5A and 5B, it can be seen that the time for which the constant-speed section of the driving unit is maintained varies depending on the operating section when the elevator operates between the floors.

Therefore, it is possible to identify the upward movement or the downward movement of the elevator and to easily extract the information about the operating section of the elevator based on the driving information of the driving unit which operates in real time depending on the base information collected in the base information collecting step S10.

That is, the method 100 of highly efficiently operating the elevator by analyzing the operation of the elevator according to the present invention may simply and clearly track the operating section and the position of the elevator by tracking and comparing the current values of the driving unit that operates the elevator.

The operating information storing step S20 is a step of measuring in real time the driving information of the driving unit when the driving unit operates, analyzing the measured information based on the base information of the driving unit which is collected in the base information collecting step S10, and extracting and storing the operating information of the elevator.

Here, the operating information storing step S20 collects the driving information of the driving unit, which is collected in real time, while classifying the driving information into the activated section, the constant-speed section, and the stopped section like in the base information collecting step S10, tracks the operating section of the elevator by comparing the base information collected in the base information collecting step S10 with the collected time for which the constant-speed section is maintained and the information on current values, and finally extracts and stores the number of operations of the elevator for the respective floors.

In the above-mentioned process, the driving information of the driving unit is collected in real time when the driving unit operates to operate the elevator, and the collected driving information is compared with the driving information of the driving unit which is collected in the base information collecting step S10. In this regard, the current values of the driving information collected in real time are primarily compared with the driving information collected in the base information collecting step S10 to identify the upward movement and the downward movement of the elevator, and the time for which the constant-speed section is maintained in the driving information collected in real time is secondarily compared with the driving information collected in the base information collecting step S10 to track the operating section.

That is, since the real-time operating information of the elevator is continuously collected as described above, the operating information of the elevator may be easily digitized in the operation control step S30 to be described below.

The operation control step S30 is a step of analyzing and digitizing the operating information of the elevator which is stored for a long period of time in the operating information storing step S20, and controlling door closing time of the elevator for the respective floors based on the digitized information.

FIG. 6 is a table of number of operations of elevator for respective floors.

As illustrated in FIG. 6, the operation control step S30 digitizes the number of operations of the elevator for the respective floors based on the information collected for a long period of time in the operating information storing step S20, and allows a maximum number of passengers to get in the elevator by extending, based on the digitized information, the door closing time of the elevator in the floor where the elevator operates frequently in order to allow the number of operations of the elevator to be naturally reduced.

In addition, the operating information storing step S20 extracts and stores the information on the time when the elevator driving unit operates and the information on the number of passengers.

Figure 7A:
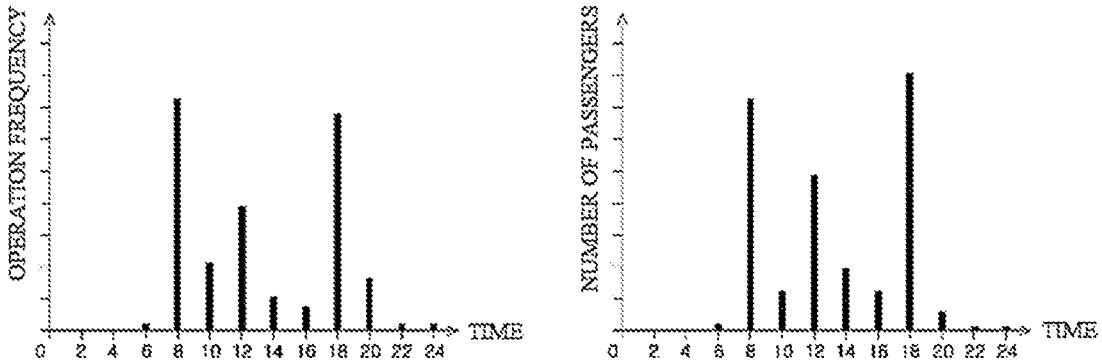
FIG. 7A is a graph illustrating number of passengers during time when elevator operates.

FIG. 7A is a graph illustrating number of passengers during time when elevator operates.

Figure 7B:
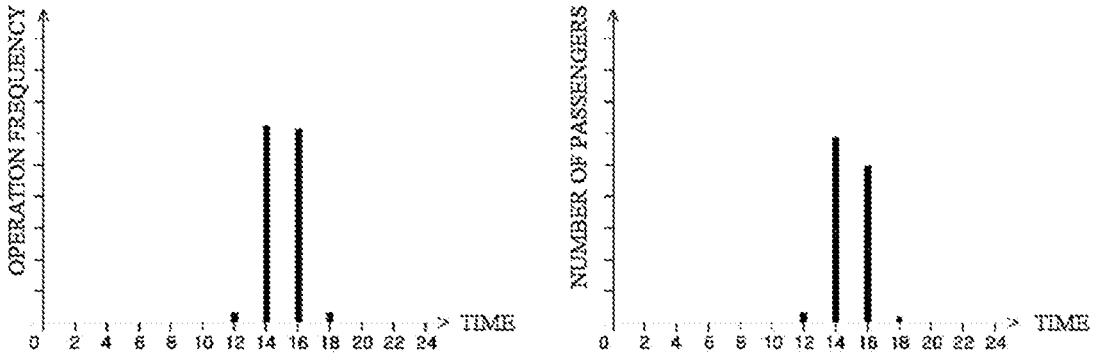
FIG. 7B is a graph illustrating number of passengers during time when elevator operates.

FIG. 7B is a graph illustrating number of passengers during time when elevator operates. As illustrated in FIGS. 7A and 7B, the operation control step S30 more effectively controls the door closing time of the elevator based on the time when the driving unit operates and the information on passengers which are digitized together with the number of operations of the elevator for the respective floors.

Here, the number of passengers in the elevator may be approximately calculated by measuring weights of the passengers by using a weight sensor.

That is, it is possible to more effectively control the door closing time of the elevator by digitizing the information on the number of operations of the elevator for the respective floors, the information on the time when the elevator operates for the respective floors, and the information on the number of passengers for the respective floors. As an example, in the case of a floor where a total number of operations is small but the number of operations is large for a particular time, the door closing time of the elevator is extended at the particular time. On the contrary, in the case of a floor where a total number of operations is large but the number of operations is small for a particular time, the door closing time of the elevator is controlled such that doors of the elevator are normally closed at the particular time. As a result, the door closing time of the elevator is efficiently controlled. In addition, the door closing time of the elevator is also extended at the time at which many passengers are concentrated, such that the closing of the doors of the elevator is efficiently controlled.

Meanwhile, the method further includes a calculation step S40 of separating and calculating electricity rates for the elevator for the respective floors in proportion to the number of operations for the respective floors based on the number of operations of the elevator for the respective floors which is digitized in the operation control step S30.

FIG. 8 is a table of electricity rates for respective floors depending on number of operations of elevator.

That is, by digitizing the number of operations of the elevator for the respective floors, the monthly rates for the elevator may be clearly and separately determined based on the total number of operations for the respective floors, as illustrated in FIG. 8, and as a result, it is possible to calculate very reasonable rates.

The method 100 of highly efficiently operating the elevator by analyzing the operation of the elevator according to the present invention, which is performed through the above-mentioned processes, distinguishes between an upward movement condition and a downward movement condition of the elevator, collects the driving information of the driving unit (the information on the change in current values over time), extracts the operating information of the elevator by analyzing the driving information of the driving unit in real time based on the collected information, digitizes (statistically calculates) the number of operations of the elevator for the respective floors, the time when the elevator operates, and the number of passengers based on the extracted operating information, and controls the door closing time of the elevator for the respective floors based on the digitized information, thereby implementing the economic operation of the elevator.

In addition, it is possible to clearly distribute the electricity rates for the operation of the elevator in proportion to the digitized number of operations of the elevator for the respective floors, and as a result, it is possible to calculate the very reasonable rates.

While the present disclosure has been described with reference to the exemplary embodiments illustrated in the accompanying drawing, the exemplary embodiments are described just for illustration, the present disclosure is not limited to the exemplary embodiments, and those skilled in the art will understand that various modifications of the exemplary embodiments and any other exemplary embodiment equivalent thereto are available. In addition, the present disclosure may be modified by those skilled in the art without departing from the spirit of the present disclosure. Accordingly, the scope of the present disclosure is not limited to the scope of the detailed description but should be determined by the appended claims and the technical spirit of the claims.

What is claimed is:

1. A method of highly efficiently operating an elevator by analyzing an operation of the elevator, the method comprising:

a base information collecting step S10 of measuring and collecting information on a change over time in magnitudes of current values of a driving unit when the driving unit for moving the elevator upward or downward moves the elevator upward in a normal state, measuring and collecting information on a change over time in magnitudes of current values of the driving unit when moving the elevator downward, classifying the measured information into driving information of the driving unit when moving the elevator upward and driving information of the driving unit when moving the elevator downward, and storing the driving information of the driving unit when moving the elevator upward and the driving information of the driving unit when moving the elevator downward as base information of the driving unit;

an operating information storing step S20 of measuring in real time the driving information of the driving unit when the driving unit operates, analyzing the measured information based on the base information of the driving unit which is collected in the base information collecting step S10, and extracting and storing a result of the analyzing of the measured information as the operating information of the elevator; and an operation control step S30 of analyzing and digitizing the operating information of the elevator which is stored for a long period of time in the operating information storing step S20, and controlling door closing time of the elevator for respective floors based on the digitized information.

2. The method of claim 1, wherein the driving information of the driving unit, which is collected in the base information collecting step S10, is collected by being classified into an activated section in which the driving unit begins to operate to move the elevator upward or downward, a constant-speed section in which the current values of the driving unit are stabilized and maintained within a predetermined range during the process of moving the elevator upward or downward, and a stopped section in which the driving unit stops operating to stop the elevator, the operating information storing step S20 collects the driving information of the driving unit, which is collected in real time, while classifying the driving information into the activated section, the constant-speed section, and the stopped section, tracks the operating section of the elevator by comparing the base information collected in the base information collecting step S10 with the collected time for which the constant-speed section is maintained and the information on current values, and finally extracts and stores the number of operations of the elevator for the respective floors, and the operation control step S30 digitizes the number of operations of the elevator for the respective floors based on the information collected for a long period of time in the operating information storing step S20, and allows a maximum number of passengers to get in the elevator by extending, based on the digitized information, the door closing time of the elevator in the floor where the elevator operates frequently in order to allow the number of operations of the elevator to be naturally reduced.

3. The method of claim 2, wherein the operating information storing step S20 extracts and stores the information on time when the driving unit operates and the information on the number of passengers, and the operation control step S30 controls the door closing time of the elevator based on the time when the driving unit operates and the information on passengers which are digitized by adding the number of operations of the elevator for the respective floors.

4. The method of claim 2, further comprising:

a calculation step S40 of separating and calculating electricity rates for the elevator for the respective floors in proportion to the number of operations for the respective floors based on the number of operations of the elevator for the respective floors which is digitized in the operation control step S30.

* * * * *